US007856112B2

(12) United States Patent
Marton et al.

(10) Patent No.: US 7,856,112 B2
(45) Date of Patent: Dec. 21, 2010

(54) DESKTOP TERMINAL FOOT AND DESKTOP SYSTEM

(75) Inventors: Trygve Frederik Marton, Oslo (NO); Johan Ludvig Nielsen, Oslo (NO); Petter Muren, Nesbru (NO)

(73) Assignee: Tandberg Telecom AS, Lysaker (NO)

( * ) Notice: Subject to any disclaimer, the term of this patent is extended or adjusted under 35 U.S.C. 154(b) by 1441 days.

(21) Appl. No.: 11/239,042

(22) Filed: Sep. 30, 2005

(65) Prior Publication Data

US 2006/0078146 A1 Apr. 13, 2006

(30) Foreign Application Priority Data

Oct. 1, 2004 (NO) ..... 20044198

(51) Int. Cl.
*H04R 9/08* (2006.01)

(52) U.S. Cl. ..... 381/355; 348/14.05; 379/420.03; 381/71.7; 381/333; 381/338

(58) Field of Classification Search ..... 381/336, 381/338, 355–356, 360–361, 365–366, 91, 381/357, 71.7, 333; 379/447, 450, 454, 455, 379/428.01, 420.03, 433.08, 436; 348/14.01–14.09
See application file for complete search history.

(56) References Cited

U.S. PATENT DOCUMENTS

| | | | | |
|---|---|---|---|---|
| 3,862,377 | A | 1/1975 | Burroughs | |
| 4,028,504 | A * | 6/1977 | Massa | 381/338 |
| 4,281,222 | A * | 7/1981 | Nakagawa et al. | 381/357 |
| 4,885,773 | A * | 12/1989 | Stottlemyer et al. | 379/420.03 |
| 5,226,076 | A * | 7/1993 | Baumhauer et al. | 379/420.02 |
| 5,436,654 | A | 7/1995 | Boyd et al. | |
| 5,606,554 | A * | 2/1997 | Shibata et al. | 370/260 |
| 5,896,461 | A | 4/1999 | Faraci | |
| 5,970,159 | A * | 10/1999 | McIntosh | 381/365 |
| 6,266,410 | B1 * | 7/2001 | Takahashi et al. | 379/420.02 |
| 6,516,066 | B2 | 2/2003 | Hayashi | |
| 6,633,647 | B1 * | 10/2003 | Markow et al. | 381/92 |
| 6,678,152 | B2 * | 1/2004 | Kim | 361/679.21 |
| 7,068,801 | B1 * | 6/2006 | Stinson et al. | 381/160 |

(Continued)

FOREIGN PATENT DOCUMENTS

DE 19859868 6/2000

(Continued)

OTHER PUBLICATIONS

Eargle, John; Handbook of Recording Engineering; 2002; Springer; 4th ed.; pp. 70-71.*

*Primary Examiner*—Curtis Kuntz
*Assistant Examiner*—Ryan Robinson
(74) *Attorney, Agent, or Firm*—Oblon, Spivak, McClelland, Maier & Neustadt, L.L.P.

(57) ABSTRACT

The present invention discloses an inventive microphone assembly for desktop communication systems. It utilises the advantages of placing the microphone in a desktop conferencing system as close as possible to the tabletop surface, without exposing the microphone for unfavourable mechanical or acoustic influence. This is achieved by building it into the footing in front of system, in a mechanically controlled and robust way. In this way, the high frequency response can be controlled to optimise sound quality, and at the same time the microphone assembly can be configured as a flexible unit that easily can be re-used in other systems.

11 Claims, 5 Drawing Sheets

U.S. PATENT DOCUMENTS

| | | | | |
|---|---|---|---|---|
| 7,366,310 | B2 * | 4/2008 | Stinson et al. | 381/92 |
| 2003/0053620 | A1 * | 3/2003 | Chen | 379/447 |
| 2003/0169876 | A1 * | 9/2003 | Vandivier | 379/431 |
| 2004/0001137 | A1 | 1/2004 | Cutler | |
| 2004/0184632 | A1 * | 9/2004 | Minervini | 381/355 |

FOREIGN PATENT DOCUMENTS

| | | |
|---|---|---|
| EP | 1111920 | 6/2001 |
| EP | 1377041 | 1/2004 |
| JP | 6141309 | 5/1994 |
| JP | 7264569 | 10/1995 |

* cited by examiner

Side view

DESKTOP TERMINAL FOOT AND DESKTOP SYSTEM

FIELD OF THE INVENTION

The invention relates to a microphone assembly in a loud speaking conference end-point.

BACKGROUND OF THE INVENTION

A conventional video conferencing end-point includes a codec, a video display, a loudspeaker and a microphone, integrated in a chassis or a rack. In larger end-points for use in meeting and boardrooms, the audio equipment is installed separately. The microphone is often placed on the meeting table so as to bring the audio recorder closer to the audio source.

However, personal video conferencing end-points, often referred to as desktop systems, are now becoming more common in offices as a substitute or supplement to larger end-points or to traditional telephony. Personal equipment is more portable, and is likely to be placed close to the user on a table. Thus, all the equipment belonging to one end-point, including the microphone is integrated in one device.

Microphones for desktop systems are normally placed where practically feasible, and fully integrated into the system assembly. In conventional desktop systems, the microphone is therefore often positioned the enclosure of the desktop, at a certain height above the tabletop. This implies several audio problems, which will be discussed in the following.

In nearly all in-house environments, degradation of audio quality appears due to reflections caused by interior, walls, floor and ceiling. In audio captured by a microphone in a conventional desktop system, this is a considerable problem because the tabletop will cause a strong reflected audio signal from the audio source contributing to the direct signal with a relatively short delay. The situation is illustrated in FIG. 1. Reflections that reach the microphone after the direct sound cause a phenomenon known as comb filtering. The appearance of a single reflection in a frequency response looks similar to the teeth in a hair comb. Comb filtering due to a single 2 ms reflection is illustrated in FIG. 2.

The upper chart shows the resulting impulse response from an audio source to the microphone when only the direct path and a single 2 ms reflection path are considered. The lower chart of FIG. 2 shows the corresponding impulse response in the frequency domain. As can be seen, the comb filtering nulls in the frequency response due to a 2 ms reflection will be spaced 1/0.002=500 Hz. The first null will appear at 500/2=250 Hz. The nulls in the frequency response attenuate certain frequencies, and degrade sound quality.

By placing the microphone closer to the tabletop, the frequency of the first null as well as the spacing between the additional nulls will be increased.

In high quality desktops, full audible bandwidth may often be required. To avoid undesirable nulls in the transmitted bandwidth, the microphone must be positioned closer to the tabletop than is achievable by positioning the microphone in the enclosure of the desktop unit. It is known from prior art that placing the microphone as close to the reflecting surface as possible without touching it, can reduce the effect of the reflection because the reflected signal and the direct signal will merge into each other as the distance between the surface and the microphone approaches zero. This is utilized in external table microphones, which are commonly connected to larger conferencing end-points.

In desktop systems however, the microphone should be fully integrated, but this implies several problems related to installation near the tabletop in a controlled and mechanically robust way and still achieve the audible benefits.

One problem is that a microphone placed at the underside of the desktop system is exposed to mechanical damages, and a microphone is particularly sensitive to this.

Further, if the desktop system contains loudspeakers used for two-way communication, there is a strong possibility for transmission of structure borne sound and vibrations excited by the speakers to the microphone. Such vibrations will also reduce the quality of sound picked up by the microphone, and they may be disturbing for the acoustic echo control.

Further, a fully integrated microphone solution is specific to the system design, and cannot easily be used as a module in a new or different system.

The requirements for sound quality are increasing as sound pickup is made using higher bandwidth audio. Also, desktop systems are often used for two-way communication, making acoustic echo and feedback control an important issue.

Microphone design, placement and assembly are therefore critical factors for the optimization of sound quality.

SUMMARY OF THE INVENTION

It is an object of the present invention to provide an arrangement that eliminates the drawbacks described above. The features defined in the independent claims enclosed characterize the invention.

In a first aspect, the present invention discloses a desktop terminal foot for supporting a telecommunication terminal on a desktop, comprising a microphone element encapsulated in the foot, and a narrow channel extending from a first inlet of said microphone element to a second inlet of a non-horizontal surface of the foot.

In a second aspect, the present invention discloses a desktop system, comprising a microphone, a display, one or more loudspeakers, and a codec in a housing supported by a footing, wherein the microphone is encapsulated in the footing, and wherein a narrow channel is extending from a first inlet of said microphone to a second inlet of a non-horizontal surface on the front side of the footing, as close to the bottom side as possible.

In a third aspect, the present invention discloses a desktop terminal foot for supporting a telecommunication terminal on a desktop, comprising a microphone element encapsulated in the foot, and an inclined channel, downwardly extending from a first inlet of said microphone element to a second inlet of a non-horizontal surface of the foot.

In a fourth aspect, the present invention discloses a desktop system, comprising a microphone, a display, one or more loudspeakers, and a codec in a housing supported by a footing, wherein the microphone is encapsulated in the footing, and wherein the footing comprises an inclined channel, downwardly extending from a first inlet of said microphone element to a second inlet of a non-horizontal surface of the front side of the footing, as close to the bottom side as possible. Advantageous embodiments of the invention are set forth in the dependent claims.

BRIEF DESCRIPTION OF THE DRAWINGS

In order to make the invention more readily understandable, the discussion that follows will refer to the accompanying drawing.

PREFERRED EMBODIMENT OF THE INVENTION

In the following, the present invention will be discussed by describing a preferred embodiment, and by referring to the accompanying drawings. However, people skilled in the art will realize other applications and modifications within the scope of the invention as defined in the enclosed independent claims.

The present invention discloses an inventive microphone assembly for desktop communication systems. It utilises the advantages of placing the microphone in a desktop conferencing system as close as possible to the tabletop surface, without exposing the microphone to unfavourable mechanical or acoustic influence. This is achieved by building it into the footing in front of system, in a mechanically controlled and robust way. In this way, the high frequency response can be controlled to optimize sound quality, and at the same time the microphone assembly can be configured as a flexible unit that easily can be re-used in other systems.

FIGS. 3-6 are illustrations of the microphone element embedded in an assembly/encapsulation/housing according to a preferred embodiment of the present invention. Here, the microphone is encapsulated in a desktop foot supporting the desktop system on the table. A small sound entry channel extends from one of the foot surfaces into the membrane of the microphone, which is tightly encapsulated by the material of the desktop foot.

Figure 1:
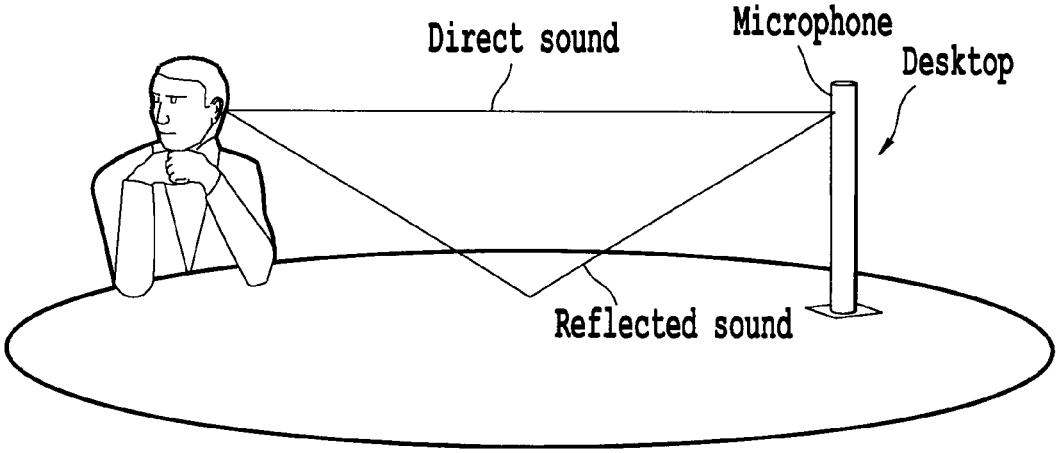
Fig.1 BACKGROUND ART
FIG. 1 shows the audio situation in traditional conference-desktop.
Figure 2:
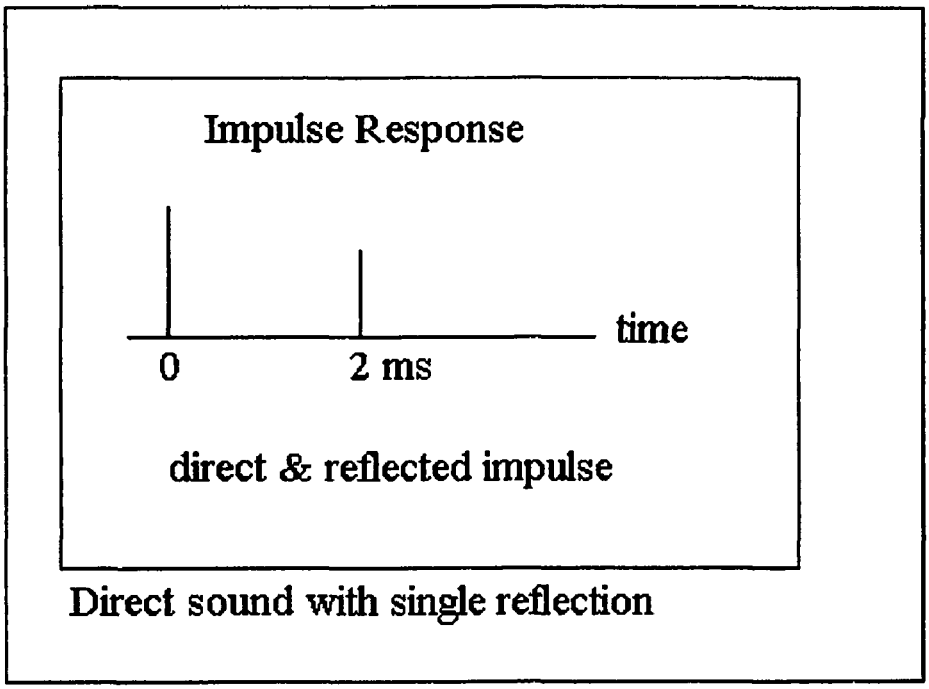
FIG. 2 is charts of the audio situation in the time and frequency domain, respectively.
Figure 2:
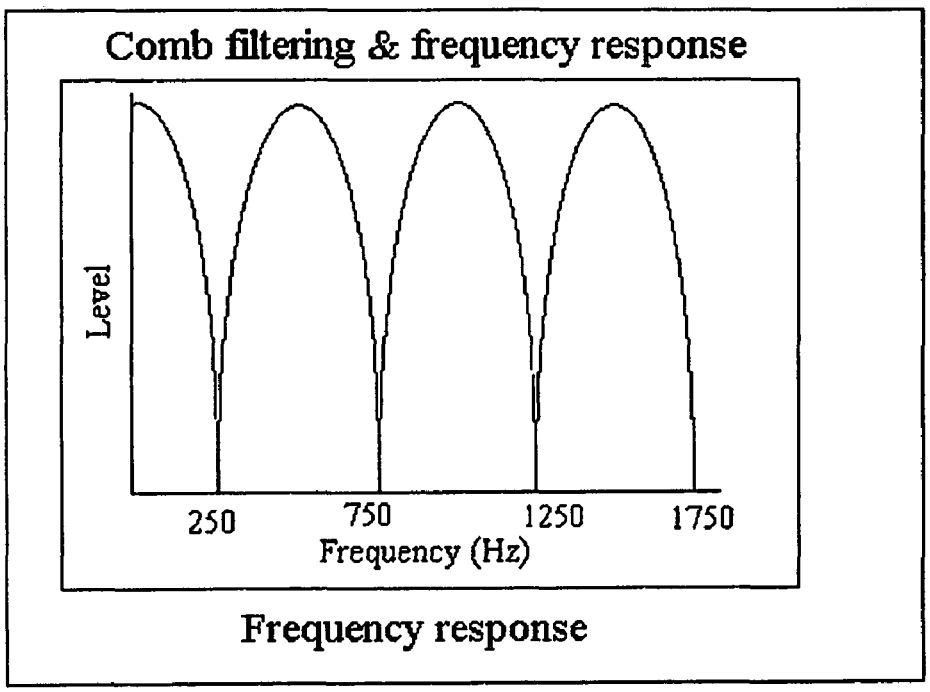
Figure 3:
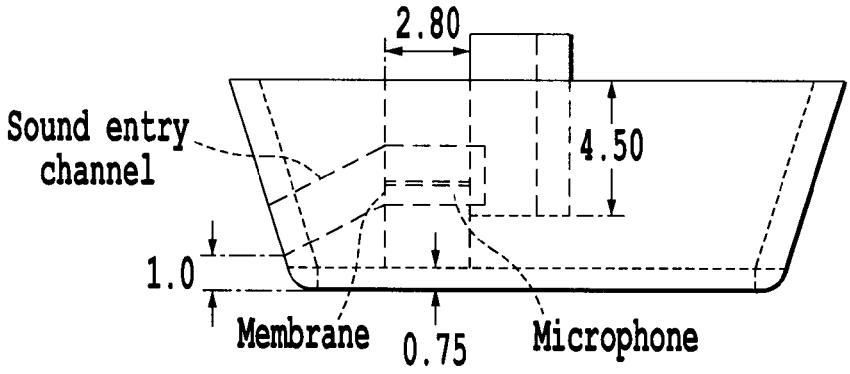
FIGS. 3-6 are sketches of a desktop system foot according to a preferred embodiment of the present invention.
Figure 4:
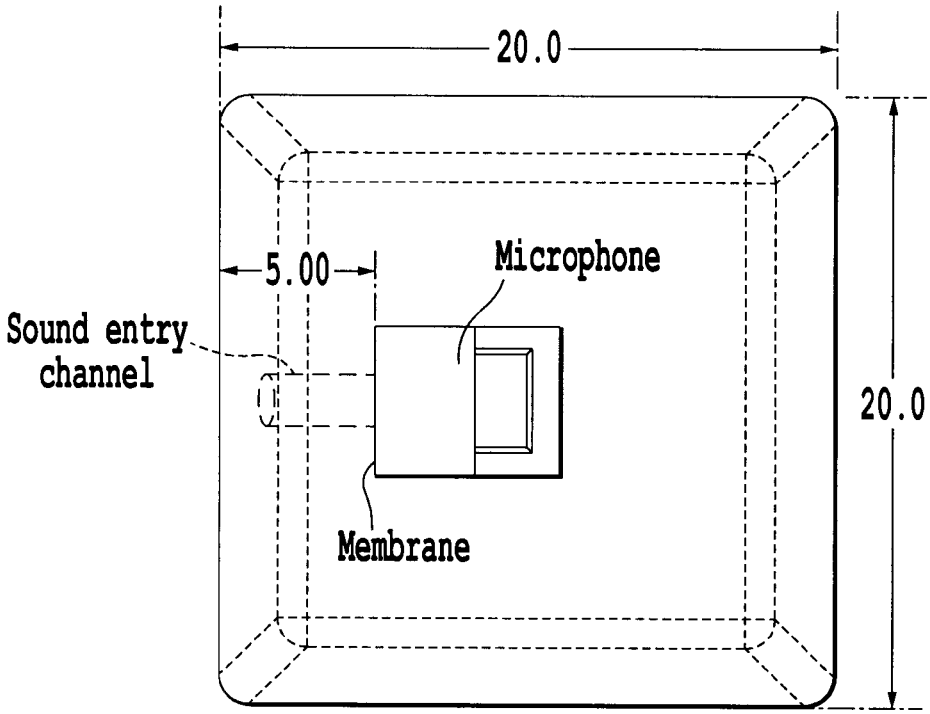
Figure 5:
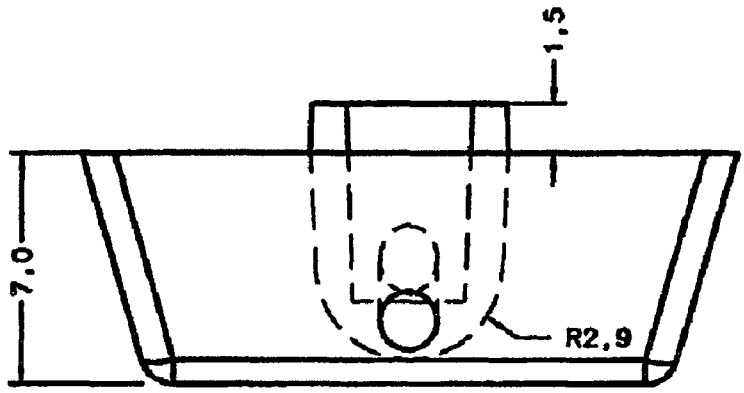

As indicated in FIG. 3, the sound entry channel is inclined downwards from the microphone entry. This is due to the physical size of the microphone. A small microphone typically being used for integrated audio pick-up in desktop systems has a diameter in the range of 4 mm to 8 mm, or more preferably about 6 mm, while the inlet has a diameter in the range of 1 mm to 3 mm, or more preferably about 2 mm. To avoid the above discussed comb filter effect, and to achieve an amplified signal due to close-up reflection in the best possible way, the sound entry should be placed as close to the tabletop as possible. However, the entry should neither not influence on the bearing capacity of the foot, nor be exposed to the dust and pollution layer on the table. Thus, in the preferred embodiment of the invention, the sound entry channel is inclined downwards so that the entry is positioned at a height in the range of 0.5 mm to 1.5 mm, or more preferably about 1 mm, above table level.

Such a precise positioning of the sound entry point very close to the table surface is secured through the use of a narrow channel from the outside to the front of the microphone element, while making the mounting slit for the element so tight that its position is fixed.

Still according to the preferred embodiment of the present invention, mechanical protection of the microphone element is secured by making the housing sturdy and rugged out of a hard material.

Further, by extending the housing and making it wider than the microphone element, some acoustic shielding from reflections from nearby surfaces is provided, producing a more even high frequency response. The widening will also provide some pressure-build up and a boosted high frequency response. This can be an advantage acoustically combined with the shielding, especially in a complex environment like at the base of a desktop appliance.

The microphone housing can be designed to be used as a foot that the desktop system rests on. This significantly reduces the degree of integration, thereby making an independent microphone module that can easily be re-used in new systems.

A cavity like the channel in front of the microphone element has a resonant behaviour, which often also will result in a boosted high frequency response. If the resonance frequency of the cavity is inside or near the audible frequency range, the degree of boost can be disturbing. To control the resonance of the cavity, the channel length and width should therefore be minimized. This will place the resonance frequency as high as possible.

A problem that may be more dominant when the microphone is placed that close to the tabletop, is the interfering structure borne noise and vibrations that may occur in the table material, originating from knocking and bumps in the table. To minimize pickup of sound and vibrations from the system assembly or the table surface, the microphone membrane should therefore be oriented vertically.

When the above aspects are considered, the following practical dimensions could be used: A channel width of 2 mm, which matches sound entry holes in a typical electret microphone element with 6 mm diameter. Minimizing the length of the channel, while maintaining robustness and sound entry close to the table, gives a practical length of 5 mm. The entry point of the channel can be placed within 1 mm of the table surface, thereby annihilating the comb filter effect in the full audio range up to and above 20 kHz. Instead, the reflected wave from the table will be in phase with the direct wave, increasing the audio pressure (this is well known in acoustic theory as a pressure doubling close to surfaces) and therefore the strength of the captured signal. The microphone's self noise is not increased, and therefore the signal-to-(self) noise ratio is increased (by 6 dB assuming a big table with a hard surface). As any reverberant signal arriving from beneath of the table is prevented to hit the microphone, the signal-to-reverberation level will also be improved (theoretically up to 3 dB).

Further, when used as a foot for a system, some means of proper positioning and threading of signal cable to the electronics in the system must be devised.

The material of the housing should be quite hard for rigidity and protection, and somewhat elastic to withstand varying stresses from the system above it, and hold the microphone in a fixed position.

The housing should cope with temporarily carrying the weight of the whole system without the entry channel permanently deforming or closing.

The material should be non-porous so as to minimize sound absorption. Experience has shown that an elastomer cast with hardness of at least shore 35 is a working compromise.

The total free-field response of the microphone in its housing, is a convolution of the microphone response, the entry channel volume response, and the pressure-build up effect on the front of the assembly. A high frequency response peak sized and shaped by the mechanical design will invariably result.

This effect is in most cases desirable. It is similar to the characteristics of a pre-emphasis filter commonly used for sound pickup of speech. It optimizes clarity and improves the signal-to-noise ratio in the following analogue-to-digital converter if the system is digital.

This influence on the frequency response is dominant compared to the effect of reflection and diffraction from nearby objects, and can therefore provide a response with less variation for changing angle from the sound source, which is advantageous.

An equalizer filter, analogue or digital, should counteract the high frequency peak and tailor the total response to the design goal of the application.

Any microphone element requiring sound wave entry from a single direction could be used. A typical choice is an omni directional electret condenser microphone. The size of the element is in principle not important, but the smaller the radius of the element the shorter the sound entry channel can be made.

Figure 6:
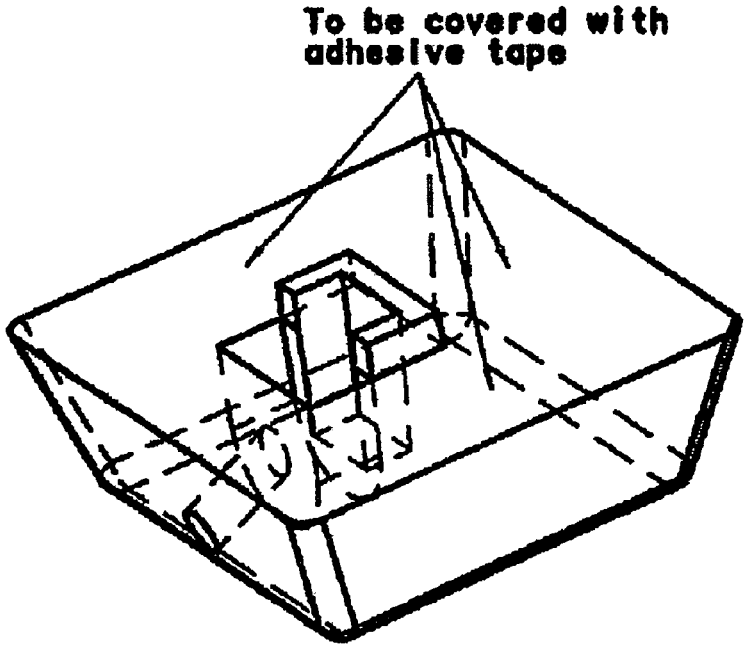
Figure 7:
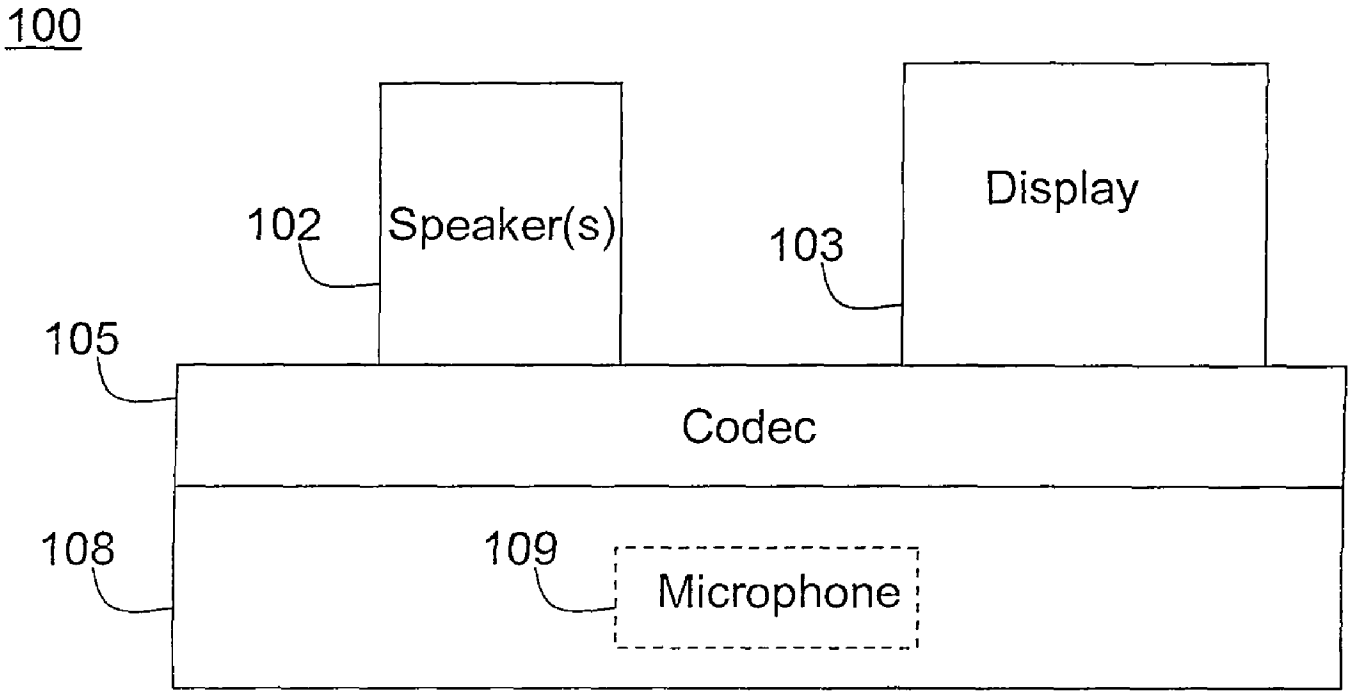
FIG. 7 is a block diagram of a desktop system according to an embodiment of the present invention.

A desktop system 100, as shown in FIG. 7 includes a microphone 109, a display 103, one or more loudspeakers 102, and a codec 105 in a housing supported by a footing 108, wherein the microphone 109 is encapsulated in the footing 108, and wherein a narrow channel is extending from a first inlet of said microphone 109 to a second inlet of a non-horizontal surface on the front side of the footing, as close to the bottom side as possible (see FIG. 6).

The main advantage of the present invention is that the housing places the microphone very close to the desktop surface or table top in front of the system in a mechanically controlled way, thereby removing comb filter effects, amplifying the captured signal and shielding parts of the reverberant sound field while keeping the microphone protected. This increases sound quality also for full audio band sound pickup.

Further, a short channel for sound entry and a slightly extended frontal surface is tuned to optimize the acoustic response. Properly designed it can be used as an acoustical pre-emphasis filter.

In addition, orienting the microphone membrane vertically minimizes pickup of structure-borne sound and vibrations from the system loudspeakers and table.

Finally, the assembly ends up as a general microphone module that can easily be adapted to different system constructions and uses.

The invention claimed is:

1. A desktop terminal, comprising:

an omni directional microphone element encapsulated in a foot, wherein a membrane of the omni directional microphone element is vertically oriented with respect to a horizontal support surface; and an inclined channel, downwardly extending from a first inlet of said microphone element to a second inlet of a non-horizontal surface of the foot, wherein said second inlet is positioned on said non-horizontal surface at a height in the range of 0.5 mm to 1.5 mm above an upper edge of the horizontal support surface, and said foot is configured to support a telecommunication terminal on the horizontal support surface.

2. The desktop terminal according to claim 1, wherein the omni directional microphone element is an electret condenser microphone connected to the telecommunication terminal as a main audio input.

3. The desktop terminal according to claim 1, wherein the channel has a width in the range of 1 mm to 3 mm, and a length in the range of 3 mm to 7 mm.

4. The desktop terminal according to claim 1, wherein said foot is made of an elastomer cast of at least 35 shore hardness.

5. The desktop terminal according to claim 1, wherein said foot is configured as a detachable component of the telecommunication terminal.

6. The desktop terminal according to claim 3, wherein said foot is configured as a detachable component of the telecommunication terminal.

7. The desktop terminal according to claim 1, wherein said telecommunication terminal is a video conference end-point.

8. A desktop system, comprising:

an omni directional microphone;

a display;

one or more loudspeakers; and a codec in a housing supported by a foot, wherein the microphone is encapsulated in the foot, a membrane of the omni directional microphone element is vertically oriented with respect to horizontal support surface, and the foot includes an inclined channel, downwardly extending from a first inlet of said omni directional microphone to a second inlet of a non-horizontal surface on a front side of the foot, the second inlet is positioned on said non-horizontal surface at a height in the range of 0.5 to 1.5 mm above an upper edge of the horizontal support surface, and said foot is configured to support said desktop system on the horizontal support surface.

9. The desktop system according to claim 8, wherein the omni directional microphone is an electret condenser microphone.

10. The desktop system according to claim 8, wherein the channel has a width in the range of 1 mm to 3 mm, and a length in the range of 3 mm to 7 mm.

11. The desktop system according to claim 8, wherein said foot is made of an elastomer cast of at least 35 shore hardness.

* * * * *